United States Patent [19]

Rosen

[11] Patent Number: 4,790,232

[45] Date of Patent: Dec. 13, 1988

[54] HOLDER FOR A GUITAR SLIDE AND PICK

[76] Inventor: Jeffrey M. Rosen, 86 Riverbank Dr., Stamford, Conn. 06903

[21] Appl. No.: 142,422

[22] Filed: Jan. 11, 1988

[51] Int. Cl.[4] ..... G10G 7/00

[52] U.S. Cl. ..... 84/329; 84/319; 84/322; 84/453

[58] Field of Search ..... 84/319, 322, 329, 453

[56] References Cited

U.S. PATENT DOCUMENTS

| | | | |
|---|---|---|---|
| 3,741,065 | 6/1973 | Harris | 84/319 |
| 4,092,894 | 6/1978 | Clough | 84/319 |
| 4,135,431 | 1/1979 | Ferguson | 84/329 |
| 4,171,659 | 10/1979 | Tumminaro | 84/319 X |
| 4,467,693 | 8/1984 | Nasfell | 84/329 |
| 4,546,688 | 10/1985 | Cuccio | 84/327 |

*Primary Examiner*—Lawrence R. Franklin

*Attorney, Agent, or Firm*—Anthony Miologos

[57] ABSTRACT

The device for retaining a slide and a pick to a stringed instrument includes a generally rectangular base having a top surface, and an arm unit extending over the base top surface. The arm unit includes an obliquely oriented slot arranged to accept and retain the pick therein. A gripping member extending from the arm unit forms a slide accepting area between the gripping member and the base top surface. A perimeter wall of the slide is inserted into the slide accepting area allowing the gripping member to apply a compressive force to the slide, retaining the slide to the device.

4 Claims, 1 Drawing Sheet

HOLDER FOR A GUITAR SLIDE AND PICK

BACKGROUND OF THE INVENTION

This invention relates in general to musical instruments, and more particularly to a unique slide and pick retention means for a stringed instrument.

In stringed instruments, the strings are often plucked with a small wafer-like pick. Picks are customarily carried in one's pocket, and are difficult to retrieve easily when needed. Further, when the pick is not needed for a short period of time, it is often laid in some convenient place and promptly forgotten. Spare picks are ordinarily unavailable in order for the musician to readily and quickly obtain a replacement.

In the past, various types of containers and spring retainers have been devised to secure the pick to the instrument, in efforts to overcome this difficulty. These devices have been limited to a location on the end piece of the stringed instrument were the retainer can be permanently attached. It would be advantageous to provide a pick retention means applicable to any type of stringed instrument which can be located anywhere on the instrument including the main body. Additionally, it would also be advantageous to be able to retain other devices which are used by a musician during the performance of a stringed instrument, such as guitar slides.

It therefor becomes an object of the present invention to provide a unique pick and slide retention device readily applicable to any stringed instrument, and easily accessible to the musician for the rapid and convenient removal and replacement of the slide and pick.

SUMMARY OF THE INVENTION

In accomplishing the object of the present invention there is provided a retention device for securing a pick and a slide to a stringed instrument. The device of the present invention includes a rectangular base having a generally planar top surface and a generally planar bottom surface.

An arm unit comprising a vertical member extends from the base top surface. A horizontal member integrally joined to the vertical member extends over the base top surface.

The vertical member includes a slot which extends obliquely through a portion of the vertical member. The slot is arranged to accept and retain the pick therein.

A gripping member is integrally joined to the horizontal member. The gripping member forms a slide accepting area between the gripping member and the base top surface. To retain the slide to the device a perimeter wall of the slide is inserted into the slide accepting area. The gripping member consequently applies a compressive force to the slide, retaining the slide to the base top surface.

The bottom surface of the base includes an adhesive layer used to mount the base to any convenient area of the stringed instrument.

BRIEF DESCRIPTION OF THE DRAWINGS

A better understanding of the invention may be had from the consideration of the following detailed description taken in conjunction with the accompanying drawings in which.

DESCRIPTION OF THE PREFERRED EMBODIMENT

Figure 1:
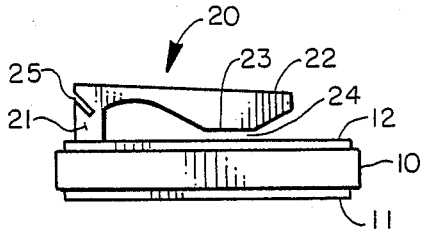
FIG. 1 is a side elevational view of the present invention.
Figure 2:
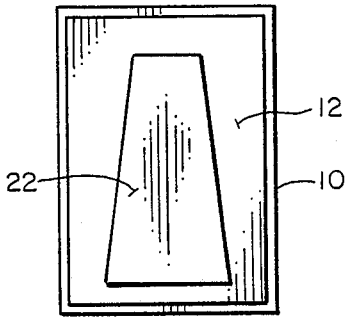
FIG. 2 is a top elevational view of the invention shown in FIG. 1.

Turning now to FIGS. 1 and 2 the holder of the present invention is illustrated. The holder is characterized by a rectangular base unit 10 having a generally planar bottom and top surface 11 and 12 respectively. The base unit 10 is constructed from a rigid material such as wood or plastic. The top surface 12 of base unit 10 includes an arm unit 20 mounted to the top surface 12. Arm unit 20 includes a vertical member 21 extending from surface 12, and a horizontal member 22 including a gripping member 23 extending over the base unit top surface 12. In a resting position horizontal member 22 is oriented slightly downward toward top surface 12, causing a space 24 to be formed between the gripping member 23 and the top surface 12 of base unit 10. The vertical and horizontal members 21 and 22 respectively, are molded as an integral unit from a resilient material such as rubber.

To accommodate a guitar pick a slot 25 is formed in the vertical member 21. The slot is oriented at an angle which is less than 90 degrees to the base unit top surface 12. The angle facilitates the insertion of the pick into slot 25.

Figure 3:
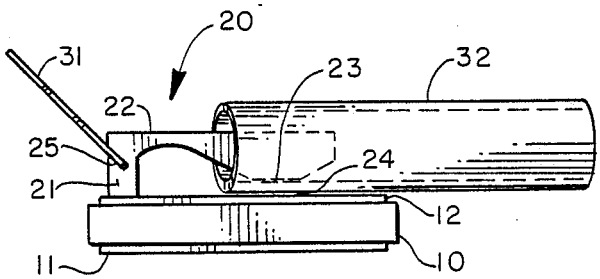
FIG. 3 is a side elevational view of the invention, showing the way in which it is used to advantage; and, FIG. 4 is a top elevational view of a stringed instrument having the present invention installed thereon.

Turning now to FIG. 3, the present invention is illustrated being used to advantage. As can be seen, the pick 31 is stored on the holder by simply inserting the pick 31 into slot 25. Slot 25 has a width slightly smaller than the width of pick 31, and in combination with the griping action provided by the rubber material of the arm unit 20, causes the pick 31 to be held firmly in place.

A steel or glass guitar slide 32 is accommodated on the holder by sliding a section of the perimeter wall of slide 32 into space 24. Due to the perimeter wall of slide 32 having a greater wall thickness than space 24, a compressive force is applied to the slide perimeter wall by the gripping member 23. Together with the gripping properties of the rubber material, the slide 32 is held securely to the holder.

Figure 4:
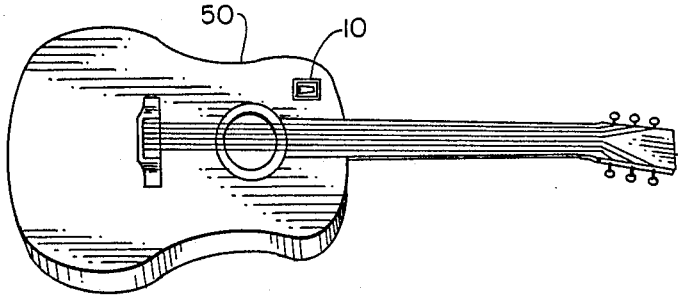

The holder of the present invention can be mounted on a stringed instrument at any location convenient to the musician, as shown in FIG. 4 for example. The mounting of the holder to a stringed instrument 50 is facilitated by providing an adhesive coating on the bottom surface 11 of base unit 10. The base unit 10 is then installed on a planar surface of the stringed instrument 50, allowing the adhesive coating to fix the holder to the stringed instrument.

It will be appreciated by those skilled in the art that the adhesive may be of the type which will allow the separation of the holder from the stringed instrument, allowing for the repositioning and or removal of the holder.

Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. Means for retaining a slide and a pick to a stringed instrument, comprising:

a generally rectangular base, said base including a generally planar top surface and a generally planar bottom surface;

an arm unit comprising a vertical member extending from said base top surface, and a horizontal member integrally joined to said vertical member extending over said base top surface;

said vertical member including a slot extending through a portion of said first member, said slot disposed to accept and retain said pick therein; and, a gripping member integrally joined to said horizontal member, said gripping member forming a slide accepting area between said gripping member and said base top surface whereby, a perimeter wall of said slide is inserted into said slide accepting area and said gripping member applies a compressive force to said slide, retaining said slide to said base top surface.

2. Means for retaining a slide and a pick to a stringed instrument, comprising:

a generally rectangular base, said base including a top surface;

an arm unit comprising a vertical member extending from said base top surface, and a horizontal member integrally joined to said vertical member, said vertical member including a slot disposed to accept and retain said pick therein; and, a gripping member, said gripping member extending from said horizontal member forming a slide accepting area between said gripping member and said base top surface whereby, a perimeter wall of said slide is inserted into said slide accepting area and said gripping member applies a compressive force to said slide, retaining said slide to said base top surface.

3. Means for retaining a slide and a pick for a stringed instrument, comprising:

a generally rectangular base constructed from a rigid material, said base including a generally planar top surface and a generally planar bottom surface, said bottom surface including means for mounting said base to said stringed instrument;

an arm unit constructed from a resilient material, said arm unit comprising a vertical member extending from said base top surface, and a horizontal member integrally joined to said vertical member extending over said base top surface;

said vertical member including a pick retention slot extending obliquely through a portion of said vertical member, said pick retention slot disposed to accept and retain said pick therein; and, a gripping member constructed from a resilient material and integrally joined to said horizontal member, said gripping member forming a slide accepting area between said gripping member and said base top surface whereby, a perimeter wall of said slide is inserted into said slide accepting area and said gripping member applies a compressive force to said slide, retaining said slide to said base top surface.

4. A Means for retaining a slide and a pick as claimed in claim 3, wherein: said means for mounting said base to said stringed instrument includes an adhesive layer having a first adhesive side applied to said base bottom surface and a second adhesive side applied to said stringed instrument thereby, retaining said base to said stringed instrument.

* * * * *